US007578485B1

(12) United States Patent
Ohmstede

(10) Patent No.: US 7,578,485 B1
(45) Date of Patent: Aug. 25, 2009

(54) METHOD FOR REDUCING DATA IN RAILWAY OPERATION

(75) Inventor: Hartwig Ohmstede, Braunschweig (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/720,239

(22) PCT Filed: Jun. 21, 1999

(86) PCT No.: PCT/DE99/01849

§ 371 (c)(1),
(2), (4) Date: Mar. 16, 2000

(87) PCT Pub. No.: WO99/67117

PCT Pub. Date: Dec. 29, 1999

(30) Foreign Application Priority Data

Jun. 23, 1998 (DE) ..... 198 28 878

(51) Int. Cl.
*B61L 3/00* (2006.01)

(52) U.S. Cl. ..... 246/182 R; 246/167 R; 246/167 D; 246/182 C; 246/122 R

(58) Field of Classification Search ..... 246/1 C, 246/3, 4, 5, 25, 27, 62, 122 F, 131, 167 R, 246/182 R, 182 B, 182 C, 187 C, 167 D; 318/587, 580

See application file for complete search history.

(56) References Cited

U.S. PATENT DOCUMENTS 4,093,161 A * 6/1978 Auer ..... 246/5
5,364,047 A * 11/1994 Petit et al. ..... 246/122 R
5,388,789 A * 2/1995 Rudershausen ..... 246/167 D
5,437,422 A * 8/1995 Newman ..... 246/5
5,452,870 A * 9/1995 Heggestad ..... 246/182 R
5,487,516 A * 1/1996 Murata et al. ..... 246/182 C
5,533,695 A * 7/1996 Heggestad et al. ..... 246/122 R
5,777,451 A 7/1998 Kobayashi et al.
5,828,979 A * 10/1998 Polivka et al. ..... 701/117
5,893,043 A * 4/1999 Moehlenbrink et al. ..... 701/207
5,950,966 A * 9/1999 Hungate et al. ..... 246/182 R

FOREIGN PATENT DOCUMENTS

| | | |
|---|---|---|
| DE | 44 06 720 | 2/1994 |
| EP | 0 748 080 A1 | 12/1996 |
| JP | 96122820.2 | 12/1996 |
| JP | 09/245 299 | 9/1997 |

OTHER PUBLICATIONS

Jan-Tecker Gayen, "Sicheres Fahren ohne Stellwerke", Beilkage, p. 22-27.

* cited by examiner

*Primary Examiner*—Mark T. Le
(74) *Attorney, Agent, or Firm*—Morrison & Foerster LLP

(57) ABSTRACT

A plurality of trains traveling along a route in the same direction are coupled virtually and then form, for the device for safeguarding the travel operations, vehicle trains, the front of which is formed by the leading vehicle of the first train and the rear of which is formed by the last vehicle of the last train. The trains are guided spaced apart by devices provided for that purpose. The devices along the route now communicate with only one vehicle of the virtually coupled trains. This provides a considerable reduction in data in comparison with data traffic with a plurality of individual trains. The virtual coupling of trains can be canceled again at any time; the devices along the route then communicate again with the individual trains.

8 Claims, 1 Drawing Sheet

METHOD FOR REDUCING DATA IN RAILWAY OPERATION

This application claims priority to International Application No. PCT/DE99/01849 which was published in the German language on Dec. 29, 1999.

TECHNICAL FIELD OF THE INVENTION

The invention relates to reduction of data traffic and in particular, to the reduction of data traffic between track bound vehicles and devices along a traveled route.

BACKGROUND OF THE INVENTION

Railway operations are usually controlled and monitored using signal cabins which ensure the safety of the railway traffic. To do this, the signal cabins use a very wide range of track sensors to monitor the locations of the trains moving in the area which they control, and ensure, by means of light signals, that successive trains do not come dangerously close to one another. In addition, signal cabins are used to switch routes for the trains, opposing moves or slanting moves being reliably avoided by means of exclusion and logic-linking procedures. The trains automatically release the parts of the route which they have cleared behind them and these parts of routes available again for the controlling and monitoring signal cabin.

Signal-cabin-controlled railway operations are appropriate to use on routes along which multiple trains are intended to travel with the greatest possible density and at the highest possible speed. Signal cabins are indispensable for controlling railway traffic on main routes. However, they require a system on the tracks for determining the position of the vehicles and a centralized system for signaling proceed aspects or travel instructions to the trains.

In order to limit the expenditure involved in determining the locations of the trains and signaling travel instructions, decentralized train protection systems, which permit safe journeys without the use of signal cabins have recently been preferred for routes with moderate traffic. In these decentralized train protection systems, the trains traveling along the route determine their respective location and transmit the location to decentralized devices along the route. These devices are commonly referred to as track area elements.

Devices along the route are preferably assigned to switches and are addressed by the trains by means of telegrams. The trains register their request to be allowed to travel along the route with the devices using telegrams. The devices along the route check whether there are already applications for opposing moves in the respective route section or whether approvals have already been given for such moves. If this is the case, the request by the vehicle wishing to travel along the route cannot be granted, in which case a message to this effect is transmitted to the requesting vehicles. The vehicle must subsequently stop no later than the point on the route up to which it still has permission to move forward. However, if at the time a train makes a request to a device along the route there has not been any request to the device to assign the route which it administers (or parts of the route) to a train which is moving forward in the opposite direction, and if a corresponding approval to travel along the route in the opposite direction has not been granted, the device along the route accepts the request originating from the train and assigns permission to the train to travel along the route which it administers. A prerequisite is that the permission to travel along the route has not already been assigned to a train located ahead of the train or that an older request for the assignment of permission to travel along the route is present from there. Permission to travel along the route administered by a device along the route can only be assigned to just one train by each of the devices along the route, a following train cannot travel on the route until the train ahead has completely cleared the route. Opposing moves on the route are not possible until all the trains traveling on this route in the assumed direction have cleared the route administered by the device along the route. In the statement above it has been assumed that between the trains moving in the assumed direction of travel toward the devices along the route there are no branches at which, for example, following trains can leave the track on which more than one train is traveling.

Vehicles moving along the route determine their respective location along the route, for example using GPS systems, and transmit to the devices along the route appropriate location messages from which devices can determine whether the route sections locked out for the trains are still being traveled along or have already been cleared. In the latter case, a request by another train for assignment of permission to travel along the respective route can then be processed, and, if appropriate, granted. The devices along the route have sufficiently precise information on the location of the route sections occupied by the individual trains if, in addition to appropriate locating information being transmitted by the trains, it is also certain that the trains are complete (i.e. include their usual number of cars). The trains must check this complete state continuously or at least at predefined chronological or spatial intervals and either transmit appropriate messages to the devices along the route or include these messages in the location messages in some suitable way. The devices along the route then take into account, for the protection of the route, either the actual length of the trains or else they take into account standardized length values.

In order to, if appropriate, make multiple requests for permission to travel along certain route sections, to continuously transmit permission messages to the vehicles and to continuously transmit location messages so that route sections which have already been cleared are made available at an early point, it is necessary to have very intensive data traffic between the trains and the devices along the route. This data traffic becomes more complex as the number of vehicles or trains passing through the route per time unit increases, the more frequent the updating of the location messages and the greater the precision with which the route is to be subdivided in a virtual fashion in order to maintain intervals between successive trains.

SUMMARY OF THE INVENTION

The invention reduces the data traffic between the trains traveling along a route and the devices along the route for protecting railway operations.

In one embodiment of the invention, there is a method for reducing the data traffic between track-bound vehicles traveling along a route and devices along the route. The method includes, for example, registering a vehicle request to be allowed to travel along the route. The vehicles are assigned permission to travel along the route according to predefined rules, the vehicles determining their respective location wherein the vehicles traveling ahead are moved closer to vehicles behind up to their braking distance. The vehicles are virtually coupled and move forward together, but independently of one another, using a vehicle-mounted distance-maintaining system. The devices along the route treat the virtually coupled vehicles as a single vehicle train whose front is determined by the front vehicle of the vehicles which were previously traveling ahead and whose rear is determined by the rear vehicle of the vehicles which were previously traveling behind. According to said features, successive trains are virtually coupled as required, with the result that the devices along the route exchange data, at least on a temporary basis, with, in each case, at least a single train. The devices along the route continue to communicate with the virtual composite train, while the actual individual trains which are present monitor their train integrity and transmit appropriate messages to the train which is communicating with the devices along the route. The trains which are coupled virtually are themselves responsible for maintaining a safe distance between each other, and the distance can be kept relatively small using, for example, radar sensors or else may be, for example, of the order of magnitude of 500 m or more. Virtual coupling of trains which are spaced apart to this extent may be appropriate, for example, if the rear train cannot contact the device along the route for whatever reasons.

In one aspect of the invention, more than two successive vehicles/vehicle trains can be coupled to form a virtual composite vehicle train. The method can also advantageously be used in an approach in which in each case more than two trains are virtually coupled to one another and treated in each case as one train by the devices along the route.

In another aspect of the invention, train integrity checks are performed by the vehicles and appropriate messages are transmitted at least indirectly to the devices along the route. The virtually coupled trains will supply the devices along the route at least indirectly with messages relating to the state of completeness of the virtually coupled trains. This permits the devices along the route to obtain reliable information on the location of the trains on the route, and thus on the occupation of the tracks.

In still another aspect of the invention, the braking distance, in addition to the relative braking distance of the successive vehicles or the absolute braking distance of the vehicles behind, safety supplements are taken into account at least for the confidence interval of the locating process, as well as data-transmission and data-acknowledgement times. If the aim is to allow trains to follow one another with the greatest possible density, the minimum distance values between the trains resulting from the braking distance should be increased with safety supplements which take into account the confidence interval of the locating process and velocity-dependent distance values for taking into account times for the transmission and acknowledgement of data.

In yet another aspect of the invention, the virtual coupling of the vehicles is canceled and the devices along the route communicate with the individual vehicles. If the virtual coupling of the trains is to be canceled again, the devices along the route should communicate again with the individual vehicles or vehicle trains and evaluate separately the location messages originating from them.

In another aspect of the invention, the vehicles communicating with the devices along the route inform the latter about the vehicles which are coupled to them virtually, and in that, in response to the detection of the cancellation of the virtual coupling the devices along the route again request at least separate location messages from the vehicles/vehicle trains following one another for the route sections along which they travel. In still another aspect of the invention, after the cancellation of the virtual coupling, the vehicles which have until now been coupled virtually report to the devices along the route and output at least separate location messages for the route sections along which they travel. The devices along the route will request separate transmission of location messages, or else the vehicles will of their own accord transmit these location messages to the route devices after the virtual coupling has been canceled.

In yet another aspect of the invention, the virtual coupling of the vehicles is performed or canceled by the vehicles. The virtual coupling of the vehicles is advantageously performed and canceled again by the vehicles because the devices along the route are intended to be used primarily to ensure safety but not to perform logistical measures.

In still another aspect of the invention, the virtual coupling is canceled when faults are detected in the distance-maintaining system. The virtual coupling of trains is intended, to be canceled in particular when faults occur in the distance control system because, given faulty distance control, it is no longer ensured that the successive vehicles do not indeed come dangerously close to one another. When the virtual coupling is canceled, which is possible at any time, the devices along the route are again presented with completely separate trains which are to be treated separately.

BRIEF DESCRIPTION OF THE DRAWINGS

The invention is explained in more detail below with reference to an exemplary embodiment illustrated in the drawing, in which drawing

DETAILED DESCRIPTION OF THE INVENTION

Figure 1:
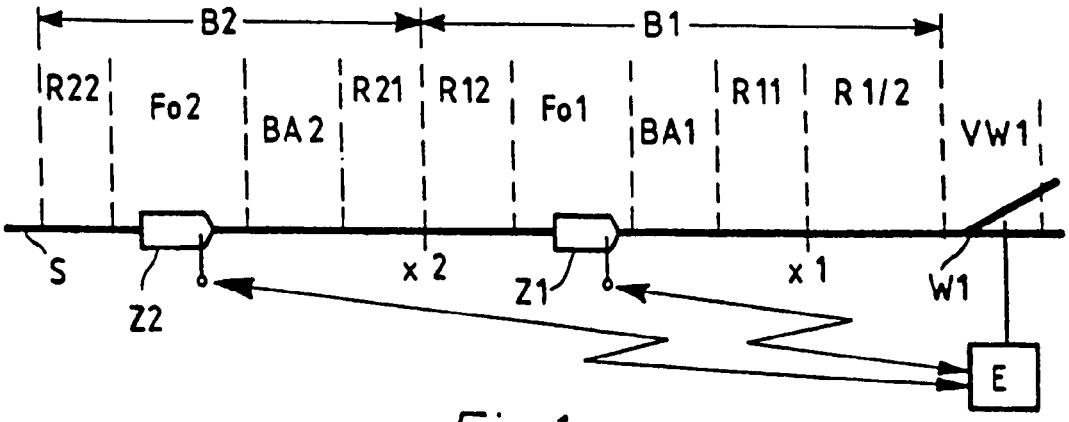
FIG. 1 shows the system for controlling two independent trains.

FIG. 1 shows a route 5 which two successive trains Z1, Z2 are traveling along in the direction of travel from left to right. The trains have a radio link to devices E along the route, which devices assign to them, as required, permission to travel along certain route sections. These devices along the route are preferably embodied as switching devices which are assigned directly to the activated track area elements; the active track area elements include, in particular, switches, diamond crossings with slips, diamond crossings with removable switch diamonds, level crossings and track locks. The devices along the route for protecting the travel operations ensure that a route section which is reserved for a train can actually be traveled on just by this one train. This can be effected in that, after the assignment of permission to travel along a route to a train, the devices along the route can pass on said permission to a following train only if the train traveling ahead has left the route section and returned the permission to the devices along the route or has canceled such respective permission. This requires the devices along the route to have information on the location of the individual trains on the route. This is effected in that the trains automatically determine their location on the route and transmit appropriate location messages to the devices along the route. Locating devices on the trains could be, in particular, satellite locating systems which the trains can use to determine their respective location on the route with sufficient precision. Using train-mounted locating devices which are preferably constructed with redundancy and diversity makes it possible to dispense with any additional track monitoring means along the route.

In order to be able to detect at any time the route which is actually occupied by a train in the devices along the route, it is necessary to have information there relating to the length and the integrity of the train. This can be effected in that the trains transmit appropriate location messages relating to the front of the train and the rear of the train to the devices along the route or make the transmission of location messages, for example relating to the front of the train, dependent on the make-up of the train being continuously checked and determined on the train. In the example illustrated in FIG. 1, the train Z1 occupies a route section FO1, which, in accordance with the confidence interval of the train-locating process is enlarged by a specific amount in comparison with the actual length of the train and thus the actual part of the route occupied; this route section along which the train travels migrates with the train, the chronological sequence of the location messages giving the impression at the devices along the route that the train moves forward along the route incrementally. In front of the train there is a route section BA1 which moves forward together with the train and whose length depends on the braking distance of the train starting from its current travel velocity or an assumed maximum velocity. This route section BA1 designates that part of the route which must be kept free for the train Z1 to continue its journey, i.e. is to be reserved exclusively for this train. In the exemplary embodiment illustrated, the devices along the route have reserved a further part R11 of the route for the train at the time under consideration, said part R11 of the route extending up to a point X1 lying ahead on the route. It is assumed that the train Z1 had requested permission to travel along the route as far as this point X1 on the route by virtue of its request to the devices along the route, and has subsequently also received the appropriate permission.

In the direction of travel behind the train Z1 there is a route section R12 which is also reserved for the train Z1 and which increases continuously as the train Z1 moves forward. This route section which is still reserved for the train but has in the meantime however already been cleared arises by virtue of the fact that the train does not continuously transmit to the devices along the route the messages indicating the location of the rear of the train on the route, rather only at certain intervals.

In the illustrated exemplary embodiment, the train Z1 has requested, and also received, permission to travel along the route as far as the point X1 on the route. The devices along the route for controlling the travel operations have determined from the permission, applied for and granted, to travel along the route as far as this point along the route and from the topography of the route that, in addition to the route section which is actually being used by the train, they must also lock out an area R1/2 between the point X1 on the route and the following track branching to moves in the opposite direction because otherwise obstructions could occur. For this reason, they have, of their own accord, also reserved this route section for the train Z1, resulting overall in a route section B1 reserved for the train.

Corresponding statements apply to a train Z2 which is following the train Z1 and which applies for permission to move forward as far as the point X2 on the route and has also received said permission from the devices along the route. Here too, there is a section FO2 which is actually occupied by the train, an associated braking section BA and sections R21 and R22 which are located behind the train and which are reserved exclusively for the train Z2; overall the train Z2 occupies the route section B2.

At least in a precise system for controlling the travel operations in which the trains transmit their location messages to the devices along the route at frequent time intervals, considerable amounts of data are transmitted and processed by the devices along the route at least if a plurality of trains travel along the route which is protected by the devices along the route. This requires a correspondingly powerful data transmission device between the trains and devices along the route and a correspondingly powerful data processing device in the devices along the route.

Figure 2:
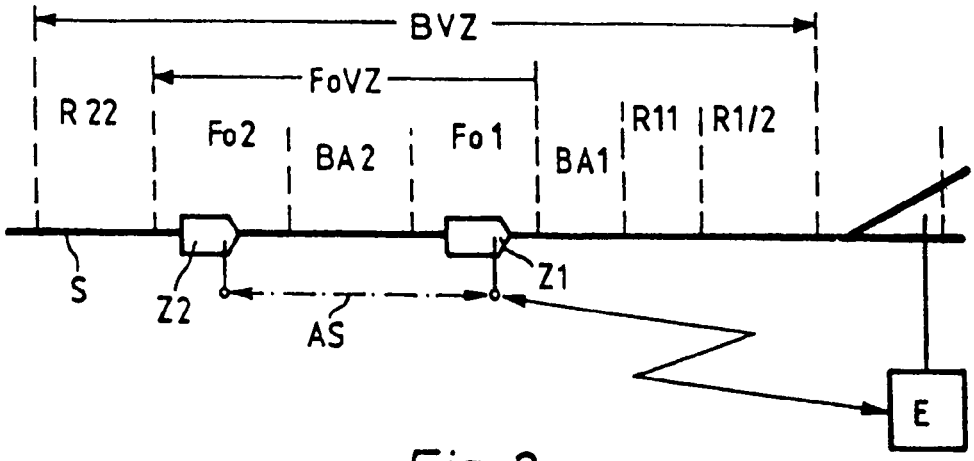
FIG. 2 shows the system for controlling two virtually coupled trains.

The invention indicates a way of reducing the amount of data which has to be transmitted in particular in the case of trains which follow one another at short intervals, and of thus obtaining less complex data transmitting and processing devices in the devices along the route. This will be explained with reference to the exemplary embodiment in FIG. 2. In said embodiment the devices E along the route communicate exclusively with the train Z1 for which, as in FIG. 1, at first just the sections FO1, BA1, R11, R12 and R1/2 have to be reserved. The following train Z2 moves, either on its own accord or under the control of the devices along the route, toward the train Z1 traveling ahead and is kept at a distance from said train Z1 by means of a suitable distance-maintaining system AS. Such devices for maintaining the distance are known per se; it is possible to use, as such devices, for example radar devices or devices for determining propagation times of location signals which have to be exchanged between the successive trains. The minimum distance between the successive vehicles is determined in FIG. 2 by the braking distance of the following train Z2. This distance can, if appropriate, be reduced further until it is equivalent to the relative braking distance from the train traveling ahead. The trains which are kept at a distance by the distance-maintaining system are then coupled to a virtual train for the devices along the route, i.e. for the devices along the route there is at least temporarily now a single train whose front is defined by the leading vehicle of the first train Z1, and whose rear is determined by the last vehicle of the train Z2. Accordingly, the route occupied by this virtual train increases to the area FOVZ between the front vehicle and the rear vehicle of the trains under consideration. The route BVZ which is reserved for the virtually coupled train by the device along the route E comprises not only the route FOVZ actually occupied but also the areas BA1, R11, R1/2 and R22. As a result of the devices along the route now communicating with one of the two trains, there is a reduction in data by 50% in comparison with the arrangement in FIG. 1, with the result that less powerful data transmitting and data processing devices can be used for the devices along the route than would actually be necessary if the trains were protected individually.

The successive trains do not necessarily have to follow one another at the shortest possible distance but it is also perfectly possible for the respective following train to follow the train ahead at a relatively large distance which could also possibly vary. In any case, after the virtual coupling of the trains, the devices along the route communicate only with one of these trains, this train preferably being the train which is respectively traveling at the front.

It is also possible to couple more than two trains to one another in a virtual fashion. The term trains can also be understood to mean vehicles traveling individually.

In the event of the virtual coupling of the trains being canceled, for example because the trains under consideration are intended to move on on different routes from then on, the devices along the route have to communicate with both trains again. To do this, the two trains inform the devices along the route of the canceling of the virtual coupling, or the devices along the route themselves bring about the canceling of the virtual coupling. As a result of this, the trains transmit, if appropriate on request, respective individual location messages, together with their individual train integrity and train length messages, to the devices along the route; if appropriate, uniform train lengths may also be assumed for the trains.

The virtual coupling of trains is canceled not only when different routes are traveled along but also, inter alia, if faults occur within the automatic distance-maintaining system of the trains. In such a case, at least one of the trains informs the devices along the route of the fault which has occurred, in response to which, after the virtual coupling has been canceled, communication is resumed with the previously virtually coupled trains, in which case, for example when there are three coupled vehicles/trains, only the two faulty ones are disconnected. If possible, appropriate commands are used to bring about a temporary reduction of the travel velocity of the following trains, so that their distance from the trains traveling ahead is increased. This makes it possible to update the location information of the trains at relatively long time intervals so that the quantity of data which has to be transmitted continues to remain approximately constant despite the canceling of the virtual coupling; however, the price paid for this is a corresponding reduction in route efficiency.

What is claimed is:

1. A method for reducing data traffic between track-bound vehicles traveling along a route and devices along the route, comprising:

registering a vehicle request to be allowed to travel along the route;

assigning permission to the vehicles to travel along the route according to predefined rules, where each of the vehicles determine a respective location on the route; and monitoring train integrity within each of the vehicles and transmitting messages to one of the vehicles selected to communicate with the devices along the route, wherein the vehicles traveling on the route are moved within braking distance of one another such that the vehicles are virtually coupled to form a virtually coupled train, the virtually coupled vehicles move together under independent operation performed by a vehicle-mounted distance-maintaining system, and the devices along the route communicate with the virtually coupled vehicles, such that a front of the virtually coupled vehicles is determined by a front most vehicle and a rear of the virtually coupled vehicles is determined by a rear most vehicle.

2. The method according to claim 1, wherein at least two successive vehicles are coupled to form the virtually coupled vehicles.

3. The method according to claim 1, further comprising monitoring safety supplements during at least a confidence interval of locating individual vehicles, data-transmission and data-acknowledgement.

4. The method according to claim 1, wherein the virtual coupling of the vehicles is canceled and the devices along the route communicate with individual vehicles.

5. The method according to claim 4, wherein the vehicles communicating with the devices along the route inform the devices about which vehicles are coupled to one another, and the devices along the route request at least separate location messages from the vehicles behind one another for the route sections along being traveled in response to cancellation of the virtual coupling.

6. The method according to claim 4, wherein after cancellation of the virtual coupling, the vehicles report to the devices along the route and output at least separate location messages for the route sections being traveled.

7. The method according to claim 1, wherein the virtual coupling of the vehicles is performed or canceled by the vehicles.

8. The method according to claim 4, wherein the virtual coupling is canceled when faults are detected in the distance-maintaining system.

* * * * *